US005083446A

United States Patent [19]

Andersson

[11] Patent Number: 5,083,446

[45] Date of Patent: Jan. 28, 1992

[54] CARRYING BAR FOR A FRAME IN A PLATE HEAT EXCHANGER

[75] Inventor: Torgny Andersson, Kävlinge, Sweden

[73] Assignee: Alfa-Laval Thermal AB, Lund, Sweden

[21] Appl. No.: 340,810

[22] PCT Filed: Nov. 19, 1987

[86] PCT No.: PCT/SE87/00541

§ 371 Date: Mar. 22, 1989

§ 102(e) Date: Mar. 22, 1989

[87] PCT Pub. No.: WO88/04023

PCT Pub. Date: Jun. 2, 1988

[30] Foreign Application Priority Data

Nov. 21, 1986 [SE] Sweden ..... 8604984

[51] Int. Cl.[5] ..... F28F 9/00; F28F 3/08

[52] U.S. Cl. ..... 165/78; 165/166

[58] Field of Search ..... 165/78, 166, 167; 16/87.4 R, 87.6 R, 96 R, 87.2, 93 D

[56] References Cited

U.S. PATENT DOCUMENTS 2,920,581 1/1960 Cook et al. ..... 104/93

FOREIGN PATENT DOCUMENTS 548586 6/1956 Belgium ..... 16/96 R
1809545 8/1969 Fed. Rep. of Germany ..... 165/166
952477 11/1949 France ..... 165/166

*Primary Examiner*—Allen J. Flanigan
*Attorney, Agent, or Firm*—Davis Hoxie Faithfull & Hapgood

[57] ABSTRACT

The present invention relates to a plate heat exchanger comprising several heat exchange plates arranged in a frame between a frame plate and a pressure plate, and suspended from a horizontal carrying bar, which has a hollow supporting body with protruding suspension means on its underside for the heat exchange plates. According to the invention the supporting body and the suspension means are formed of a bent sheet material, and the carrying bar has opposite side walls (3, 15, 16) which extend to abutment against each other and are joined to each other at least at lower support surfaces (6) located close to a vertical center plane through the carrying bar, and which beneath said support surfaces (6) extend away from said central plane to form said suspension means.

8 Claims, 2 Drawing Sheets

CARRYING BAR FOR A FRAME IN A PLATE HEAT EXCHANGER

Figure 1:
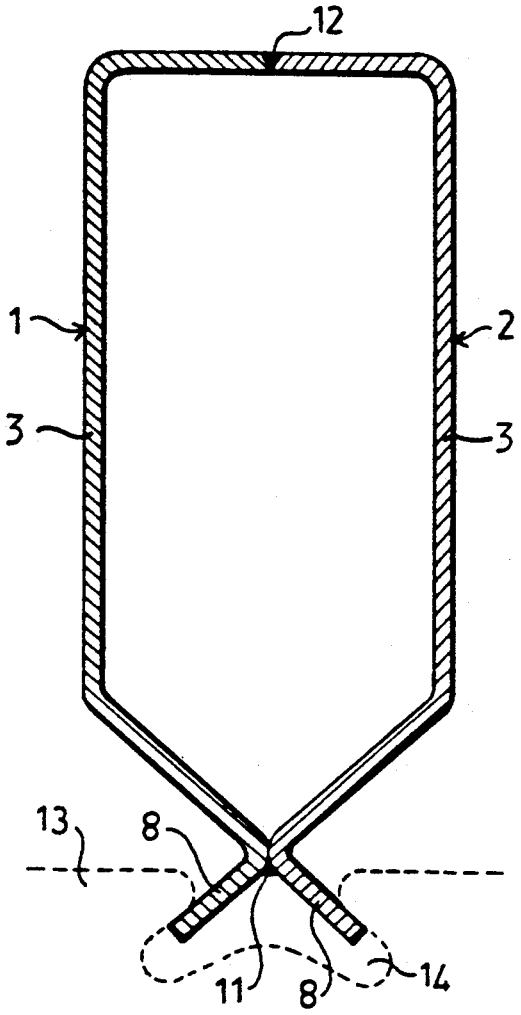

The present invention relates to a plate heat exchanger comprising several heat exchange plates arranged in a frame between a frame plate and a pressure plate, and suspended from a horizontal carrying bar, which has a hollow supporting body with protruding suspension means on its underside for the heat exchange plates.

Plate heat exchangers of this kind are common and a number of different types of carrying bars have been suggested for them. A previously known type of carrying bar is shown for instance in GB 624 865 and is essentially in the form of an I-beam, which is dimensioned with reference to recesses in the heat exchange plates. However, this carrying bar has not been sufficiently stiff against torsion in connection with large plate heat exchangers. Therefore, another type of carrying bar has been suggested, which is made of a hollow supporting body having a rectangular cross section, on the underside of which a part of an I-beam has been welded for carrying of the heat exchange plates. Carrying bars of both the above mentioned types are most expensive to manufacture.

A further type of carrying bar is shown in GB 624 865. Such a carrying bar is made of bent sheet material so that an upper hollow supporting body is formed, which at the bottom carries suspension means for the heat exchange plates. The suspension means have a width exceeding that of the supporting body, and consequently this type of carrying bar cannot be made too large, if the above mentioned recesses in the heat exchange plates should have reasonable dimensions.

Another problem arises when known carrying bars are used for plate heat exchangers in the food industry. Great demands are made on hygiene, and parts included in the plate heat exchangers must have a surface of a corrosion resistant material. It would be possible to manufacture the known carrying bars of a corrosions resistant material, but this would further increase the costs. Instead, up to now one has covered the carrying bars with a very thin sheet of stainless steel.

The object of the present invention is to provide a carrying bar which is inexpensive to manufacture irrespective of whether it is made of a corrosion resistant material or some other cheaper material. The carrying bar should also be simple to manufacture in different sizes for different plate heat exchangers. Another object is to keep down the weight of the carrying bar.

These objects are achieved with a plate heat exchanger of the initially described kind which essentially is characterized in that the supporting body and the suspension means are formed of a bent sheet material and that the carrying bar has opposite side walls, which extend to abutment against each other and are joined to each other at least at lower support surfaces located close to a vertical central plane through the carrying bar, and which beneath said support surfaces extend away from said central plane to form said suspension means.

By the present invention several advantages are achieved in comparison with carrying bars of the known type. On the one hand one starts from a sheet material which is being bent to a suitable form, which makes the proposed carrying bar very simple and inexpensive to manufacture, even if it is formed out of a corrosion resistant material, and on the other hand both the suspension means and the hollow beam of the carrying bar can easily be adapted to different heat exchange plates and/or to different sizes of the plate heat exchanger. The carrying capacity of the carrying bar can be varied by changing of the form of the carrying bar and/or by varying of the thickness of the sheet material. The carrying bar may of course be made by bending of only one sheet of material, but it has proved more suitable to make the carrying bar by bending of sheet material into two equal parts which are put together and fixed by welding to each other. Thus, within the scope of the invention it is obtained a great freedom of dimensioning the carrying bar for different existing recesses of different heat exchange plates, and independently of the shape of the recesses, for a required bending and torsional stiffness.

Figure 2:
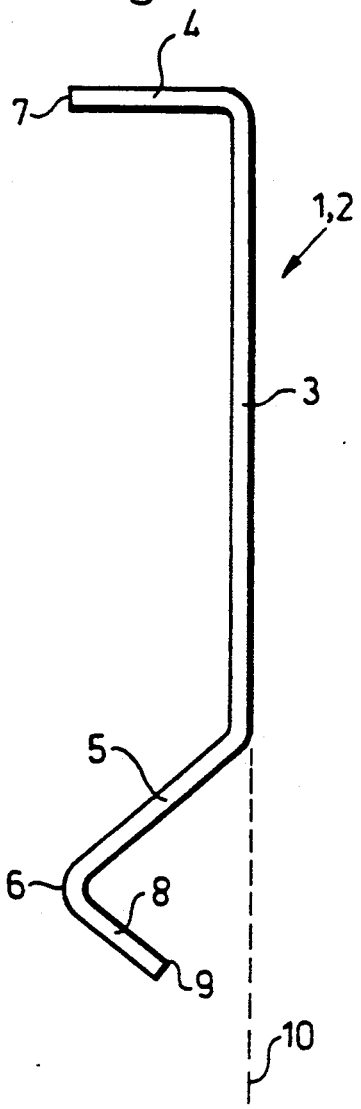
Figure 3:
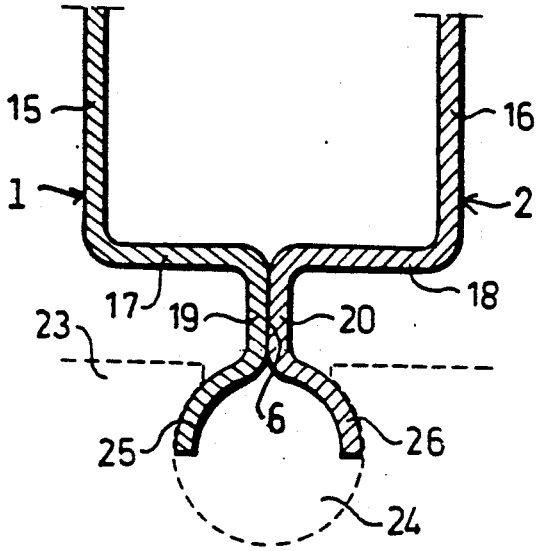
Figure 4:
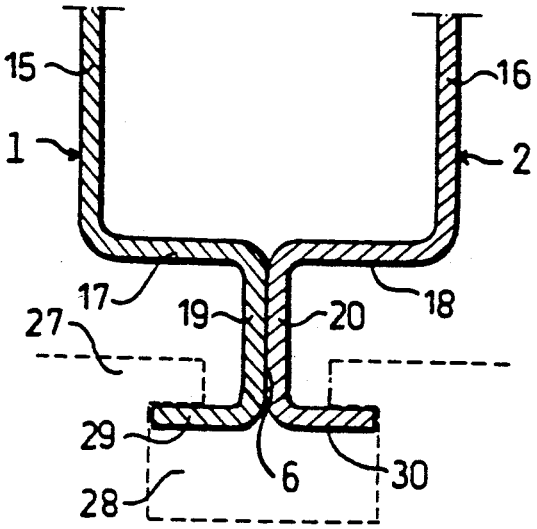

The invention will be described further below with reference to the accompanying drawings, in which FIG. 1 shows a cross section through a carrying bar according to a first embodiment, FIG. 2 shows a cross section through one part of the carrying bar according to FIG. 1, FIG. 3 shows a cross section through the lower portion of a carrying bar according to a second embodiment, and FIG. 4 shows a cross section through the lower portion of a carrying bar according to a third embodiment.

In FIGS. 1 and 2 there is shown a first embodiment of a carrying bar according to the invention, which has a hollow supporting body with protruding suspension means on its underside and which is assembled of two parts 1 and 2, which are formed of a bent sheet material, preferably of stainless steel, and which are fixed against each other. The carrying bar has a length essentially equal to the distance between a frame plate and a pressure plate in a plate heat exchanger, and has opposite side walls which extend to abutment against each other close to a vertical central plane through the carrying bar. Each part 1 and 2 has a vertical main portion 3, which continues in an upper horizontal portion 4 having a horizontal extension which essentially corresponds to half the thickness of the carrying bar. The upper horizontal portion terminates in an upper support surface 7. The vertical main portion 3, which has a somewhat smaller vertical extension than the thickness of the carrying bar, continues in its lower part in a portion 5 directed obliquely downwards and which extends essentially as far as the horizontal portion to form a lower support surface 6. Said portion 5 continues in its turn in a portion 8 situated under said support surface 6 and extending away from said central plane. The angle between the portion 8 and the portion 5 is within the range of $90° \pm 45°$ and preferably within the range of $90° \pm 20°$. The portion 8 thus is directed obliquely downwards and its end portion 9 is essentially between a border line 10 of the vertical portion 3 and a border line between the support surfaces 6 and 7 of the two portions 4 and 5. When two parts 1 and 2 are put together, the portions 8 extend in the form of two flanges away from each other and form the suspension means of the carrying bar.

To form a carrying bar one takes two equal plates 1 and 2, one of them having been turned halfway around its vertical centre line, and puts them against each other. Then the plates 1 and 2 will abut against each other near the vertical central plane through the carrying bar partly along a horizontal line corresponding to the contact points between the support surfaces 6 of the two portions 5 and partly along a horizontal line corresponding to the contact points between the support surfaces 7 of the two portions 4. Along said two lines the plates are fastened to each other, preferably by means of a welding joint 11 and 12 as shown in the figure. Instead of welding, soldering, riveting or gluing may be used. Also a screw joint can be used.

The two plate portions 8 of the plates 1 and 2 function, as indicated in FIG. 1, as suspension means for a heat exchange plate 13. Through the special design of the portions 8, which extend obliquely downwards and away from each other, they will abut against the flanks of the dovetail formed groove 14 of a heat exchange plate 13. Hereby the carrying bar functions perfectly for the most common type of suspension groove of the heat exchange plate.

In FIGS. 3 and 4 there is shown a lower part of a carrying bar according to two other embodiments. The carrying bars, as in the embodiment according to FIGS. 1 and 2, are made of two equal parts fastened to each other, and the upper part of the carrying bar corresponds to what has been shown in FIG. 1. However, the lower part of the carrying bars has a different design to better fit and cooperate with heat exchange plates, in which the recess for the suspension means of the carrying bar has a design other than that of a dovetail formed groove.

Common for both embodiments is that the vertical side walls 15 and 16 of the carrying bar continue in respective lower horizontal portions 17 and 18, each of which is directed towards said central plane, where these portions meet each other. The lower horizontal portions 17 and 18 continue in each respective vertical portions 19 and 20 forming support surfaces 6 which abut against each other.

The carrying bar according to FIG. 3 is intended for a heat exchange plate 23 having a circular recess 24. To fit this kind of recess the lowest portion of the carrying bar is essentially semicircular, the lower vertical portions 19 and 20 of the two parts continuing in a respective portion 25 and 26 formed as a quarter of a circle, which two portions when put together form a carrying bar, in which a cross section through the lower part of the carrying bar gets a semicircular form. The portions 25 and 26 are thus intended to abut against the circular recess 26 of the heat exchange plate 23. It is of course possible to modify the portions 25 and 26 so that these together form a circle.

The carrying bar according to FIG. 4 is meant to cooperate with a heat exchange plate 27 having a quadratic or rectangular recess 28. For this purpose the lowest part of the carrying bar has two horizontal protrusions 29 and 30 directed away from each other and starting from their respective vertical portions 19 and 20.

I claim:

1. Plate heat exchanger comprising several heat exchange plates arranged in a frame, between a frame plate and a pressure plate, and suspended from a horizontal hollow carrying bar having spaced opposite side walls joined along the upper part of the bar, and having protruding suspension means on its under-side for the heat exchange plates, said side walls and said suspension means being formed of bent sheet material, characterized in that the side walls extend to abutment against each other and are joined to each other at support surfaces located at the lower part of the carrying bar close to a vertical central plane through the latter, the side walls extending further beneath said support surfaces and away from said central plane to form said suspension means, and further characterized in that the carrying bar above said lower support surfaces has a width exceeding the distance between the outer ends of said suspension means, and in that said carrying bar consists of two equal parts abutting against each other.

2. Plate heat exchanger according to claim 1, characterized in that the lower parts of the side walls form two flanges extending away from each other.

3. Plate heat exchanger according to claim 1 or 2, characterized in that the cross section through each part of the carrying bar has an upper horizontal portion and a vertical main portion, that continues into a lower portion directed obliquely downwards, the upper and lower portions being arranged so that they are directed in the same direction in relation to the vertical main portion.

4. Plate heat exchanger according to claim 3, characterized in that the lower portion of each carrying bar continues in an obliquely downwards directed portion forming an angle of $90° \pm 45°$ with the lower portion, whereby the downwards directed portions of two parts of the carrying bar abutting one another form said flanges.

5. Plate heat exchanger according to claim 4, characterized in that each part of the carrying bar has an upper support surface and a lower support surface, the respective support surfaces of two abutting against one another parts of the carrying bar being welded to each other to form the carrying bar.

6. Plate heat exchanger according to claim 1 or 2, characterized in that a cross section through each part of the carrying bar has an upper horizontal portion and an upper vertical portion, which latter continues in a lower horizontal portion directed in the same direction as the upper horizontal portion, and that the lower horizontal portion continues in a lower vertical portion, which forms one of said lower support surfaces of two parts of the carrying bar abutting one another, which lower support surfaces together with the upper support surfaces at the ends of the upper horizontal portions are welded to each other for forming the carrying bar.

7. Plate heat exchanger according to claim 6, characterized in that the lower vertical portion continues in a portion formed as a quarter of a circle which, when two such portions abut against each other, form said suspension means for the heat exchange plate.

8. Plate heat exchanger according to claim 6, characterized in that the lower vertical portion continues in a horizontal protrusion which, when two such protrusions are arranged against each other, form said suspension means for the heat exchange plate.

* * * * *